US007771242B2

(12) United States Patent
Xue et al.

(10) Patent No.: US 7,771,242 B2
(45) Date of Patent: Aug. 10, 2010

(54) ELECTRICAL CONNECTOR WITH IMPROVED CONTACT POSITION STRUCTURE

(75) Inventors: Zhang-Lan Xue, Kunshan (CN); Chen-Xi Wang, Kunshan (CN); Hong-Qiang Han, Kunshan (CN); Lun-Song Hu, Kunshan (CN); Zi-Qiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/386,651

(22) Filed: Apr. 21, 2009

(65) Prior Publication Data

US 2009/0264020 A1 Oct. 22, 2009

(30) Foreign Application Priority Data

Apr. 21, 2008 (CN) ..... 2008 2 0034871 U

(51) Int. Cl.
*H01R 13/514* (2006.01)

(52) U.S. Cl. ..... 439/752; 439/607.55; 439/682

(58) Field of Classification Search ..... None
See application file for complete search history.

(56) References Cited

U.S. PATENT DOCUMENTS 4,319,800 A * 3/1982 Bernat ..... 439/686
5,490,800 A * 2/1996 Benes et al. ..... 439/567
6,250,969 B1 * 6/2001 Cai ..... 439/682
6,290,512 B1 * 9/2001 Mullen, Jr. ..... 439/106
6,776,664 B1 * 8/2004 Huang ..... 439/660
6,994,598 B2 * 2/2006 Holmes et al. ..... 439/752.5
7,223,131 B2 * 5/2007 Moll et al. ..... 439/752
7,347,745 B1 * 3/2008 Raudenbush et al. ..... 439/752
2007/0178765 A1 * 8/2007 Amano et al. ..... 439/607
2007/0218778 A1 9/2007 Lappoehn

* cited by examiner

*Primary Examiner*—Michael C Zarroli
(74) *Attorney, Agent, or Firm*—Wei Te Chung; Andrew C. Cheng; Ming Chieh Chang

(57) ABSTRACT

An electrical connector (100) includes an insulative housing and a plurality of contacts (3) retained in the insulative housing. The insulative housing includes a number of receiving slots (110) and a number of retaining slots (22) communicating with each other along a front-to-back direction. Each contact (3) has a securing portion (30) engaging with the retaining slot (22), a contact portion (33) extending forwardly into the receiving slot (110) from the securing portion (30), and a tail portion (34) extending out of the insulative housing from the securing portion (30). The retaining slot (22) defines a first inclined face (220) at an inner wall thereof. The securing portion (30) has a second inclined face (300) corresponding to the first inclined face (220) and abutting against the first inclined face (220).

18 Claims, 6 Drawing Sheets

2

ELECTRICAL CONNECTOR WITH IMPROVED CONTACT POSITION STRUCTURE

BACKGROUND OF THE INVENTION

1. Field of the Invention

The present invention relates to an electrical connector, and more particularly to electrical connectors with an improved contact position structure.

2. Description of Related Art

Various electrical connectors for printed circuit boards are offered by applicants in a variety of different designs. An electrical connector generally comprises an insulative housing and a plurality of contacts retained in the insulative housing. The insulative housing defines a plurality of cylindrical passageways for retaining the contacts therein. The contacts are cylindrical and each has a securing portion fixed in the passageways. The securing portion has a plurality of tabs extending outwardly. The tabs engage with an inner wall of the passageways for preventing the contact from moving along a length direction thereof.

However, the insulative housing does not have any position device to prevent the contacts from rotating in the passageways. The contacts would be difficult to be positioned in the passageways exactly, and the assembly time of the electrical connector is increased.

Hence, an electrical connector with improved contact position structure is desired to overcome the disadvantage of the prior art.

BRIEF SUMMARY OF THE INVENTION

According to one aspect of the present invention, an electrical connector comprises: an insulative housing comprising a plurality of receiving slots and a plurality of retaining slots communicating with the receiving slots along a front-to-back direction; and a plurality of contacts retained in the insulative housing, each contact having a securing portion engaging with the retaining slot, a contact portion extending forwardly into the receiving slot from the securing portion, and a tail portion extending out of the insulative housing from the securing portion; wherein the retaining slot defines a first inclined face at an inner wall thereof, and the securing portion has a second inclined face corresponding to the first inclined face and abutting against the first inclined face.

According to another aspect of the present invention, an electrical connector comprises: an insulative housing comprising a first housing and a second housing fixed with each other along a front-to-back direction, the first housing defining a plurality of receiving slots, the second housing defining a plurality of retaining slots corresponding to the receiving slots; and a plurality of contacts retained in the insulative housing, each contact having a securing portion mounted in the retaining slot from a front end of the second housing, a contact portion extending into the receiving slot from the a rear end of the first housing, and a tail portion extending out of a rear end of the second housing from the securing portion; wherein the retaining slot defines a first inclined face at an inner wall thereof, and the securing portion has a second inclined face corresponding to the first inclined face and abutting against the first inclined face to prevent the contact from rotating.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
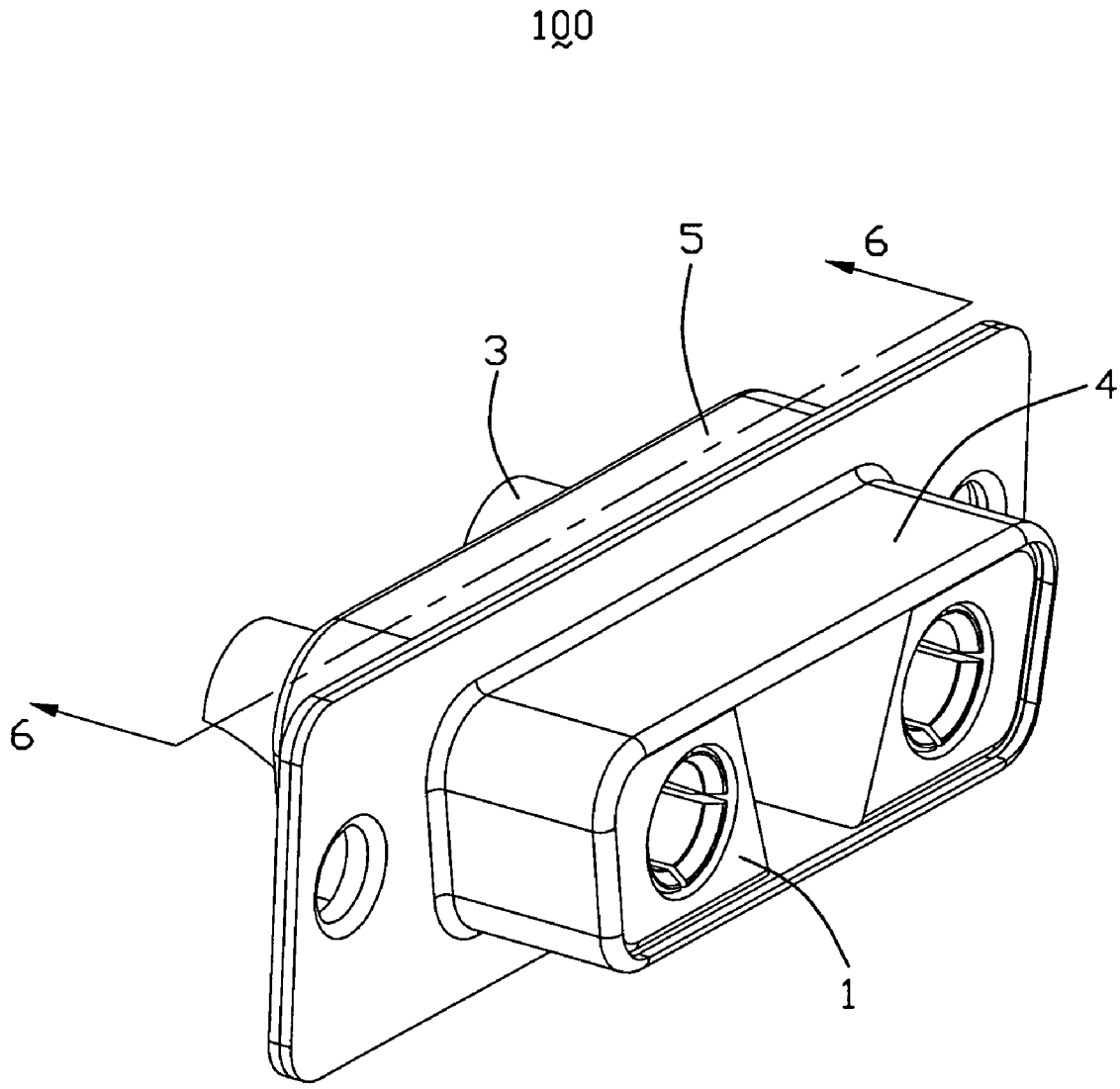
FIG. 1 is a perspective view of an electrical connector according to the present invention.
Figure 2:
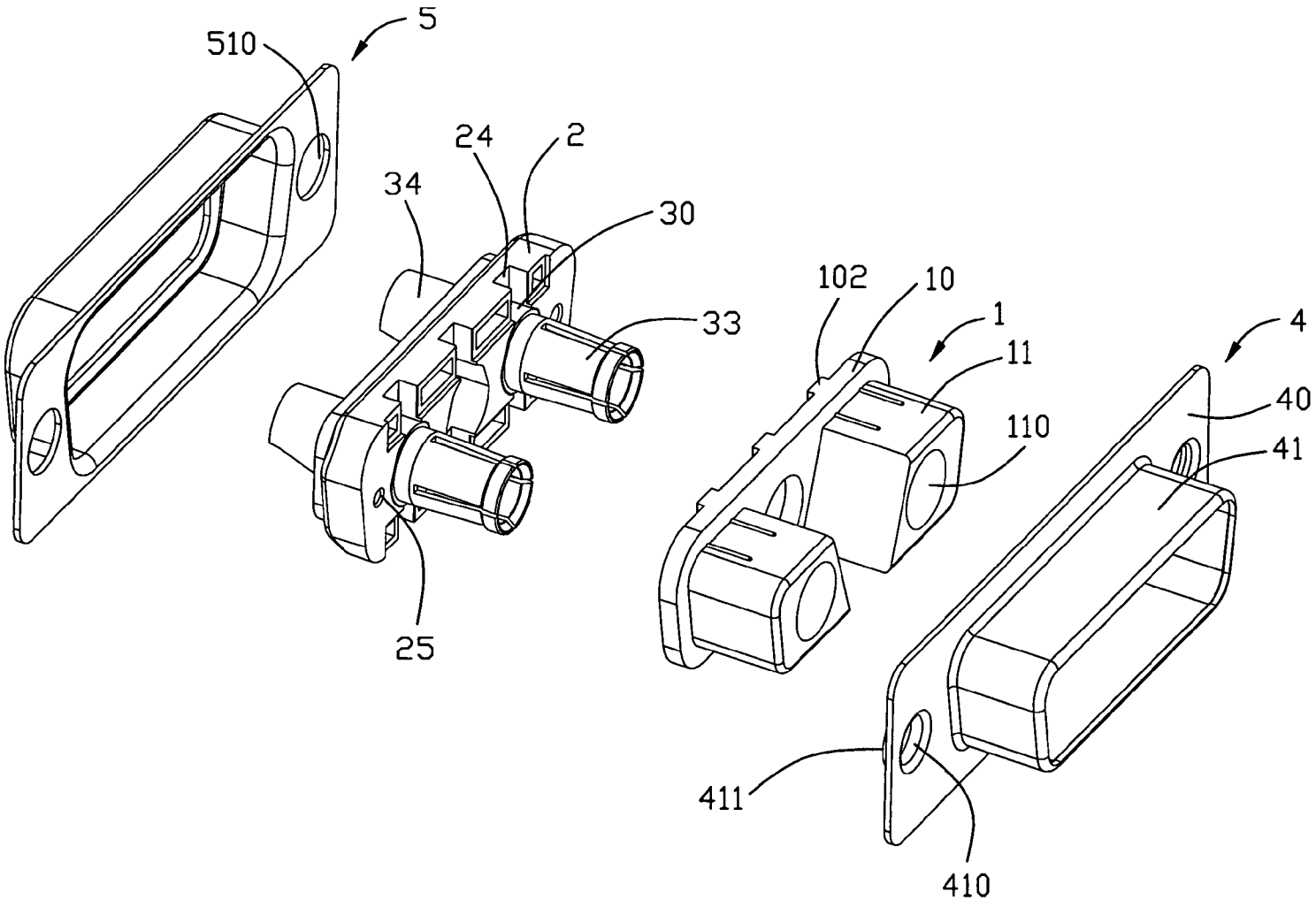
FIG. 2 is a partial exploded view of the electrical connector shown in FIG. 1.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-6, an electrical connector 100 for transmitting power signals according to the present invention is disclosed. The electrical connector 100 is a power connector and comprises an insulative housing, a pair of contacts 3 retained in the insulative housing, and a front shell 4 and a rear shell 5 covering the insulative housing. The insulative housing comprises a first housing 1 and a second housing 2 fixed with each other along a front-to-back direction thereof.

Figure 3:
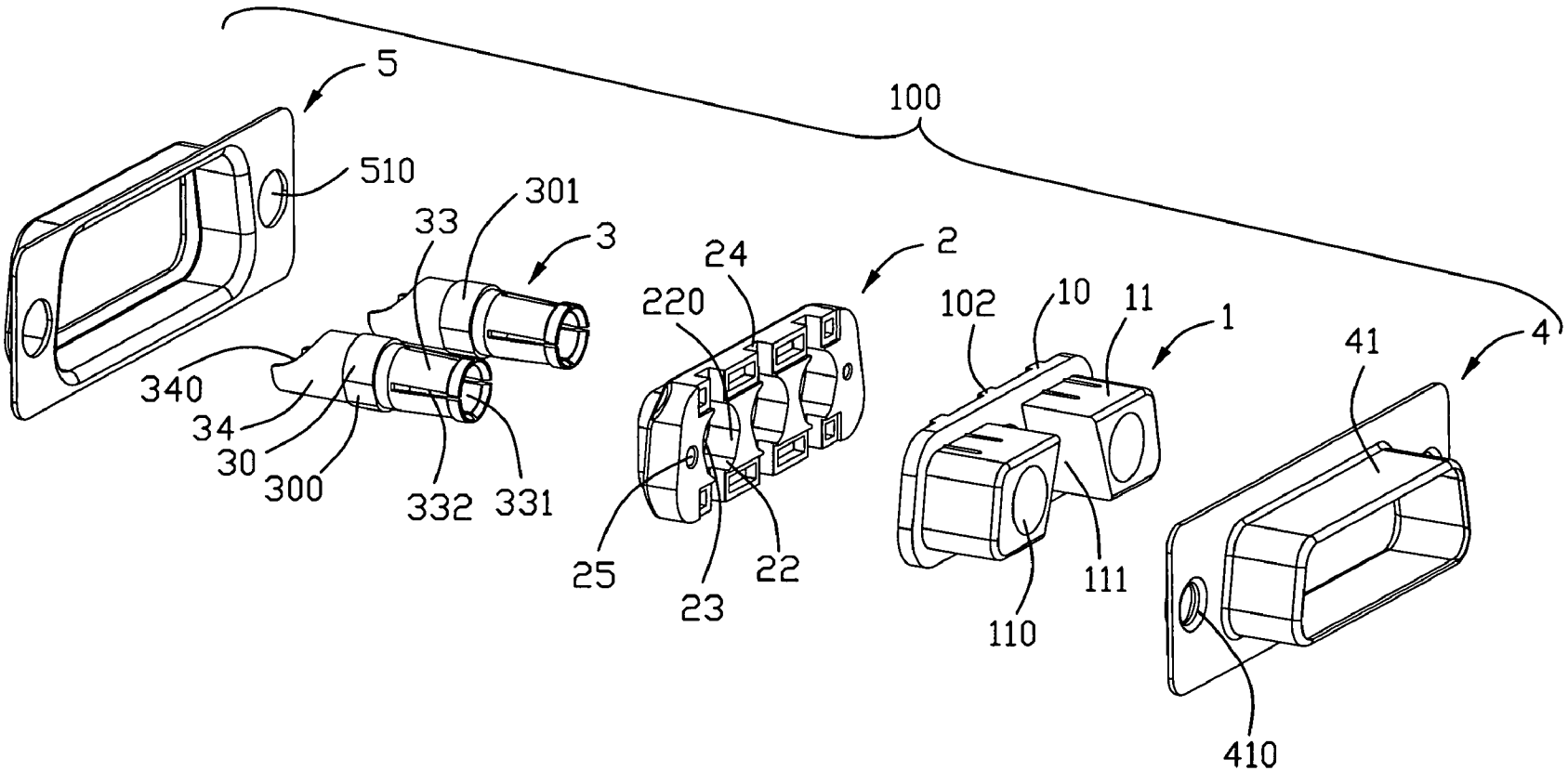
FIG. 3 is an exploded view of the electrical connector shown in FIG. 1.
Figure 4:
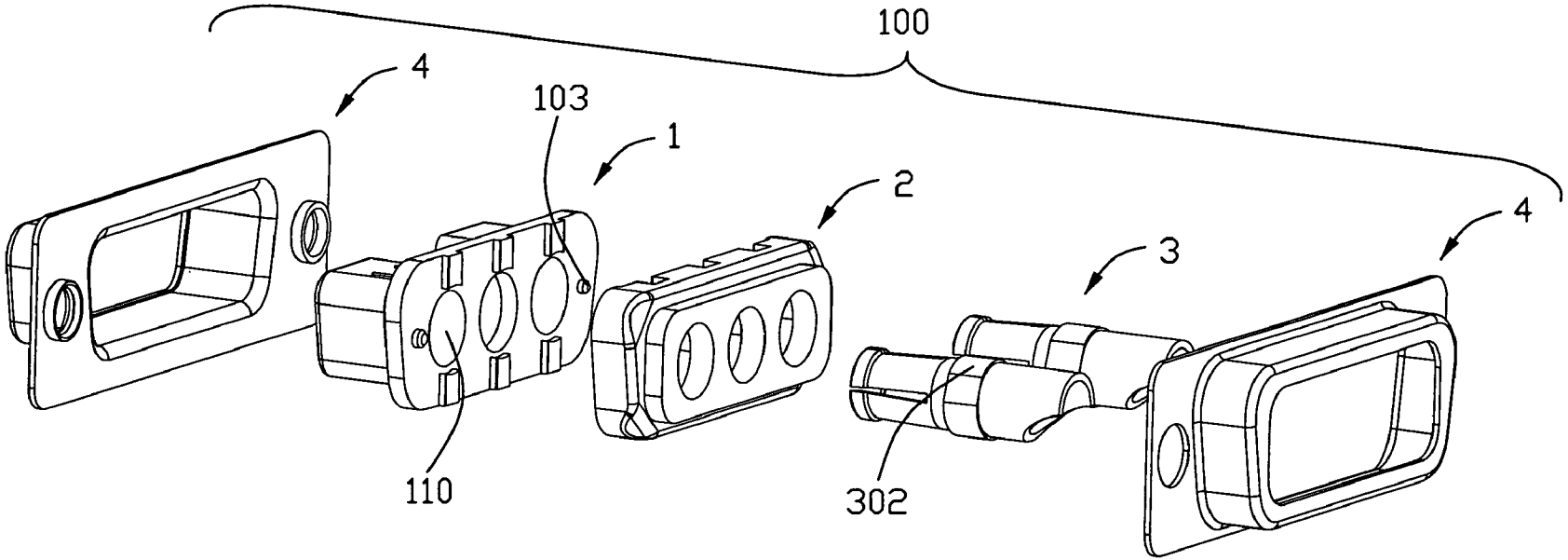
FIG. 4 is a view similar to FIG. 3, while taken from another aspect.

Referring to FIGS. 3-4, the first housing 1 comprises a base portion 10 and a pair of mating portions 11 extending forwardly from a front wall of the base portion 10. The two mating portions 11 are symmetrical along a width direction of the first housing 1 and form a cavity 111 therebetween to receive a corresponding plug. The first housing 1 defines three cylindrical receiving slots 110 arranged in a row along the width direction. Two outside receiving slots 110 extend through the base portion 10 and the mating portions 11, and a middle receiving slot 110 extend through the base portion 10 and communicate with the cavity 111. The base portion 10 further comprises a plurality of protrusions 102 projecting backwardly from a rear wall thereof for engaging with the second housing 2, and a pair of posts 103 extending backwardly from two sides of the rear wall. The protrusions 102 are located at an upper portion and a lower portion of each receiving slots 110.

Figure 5:
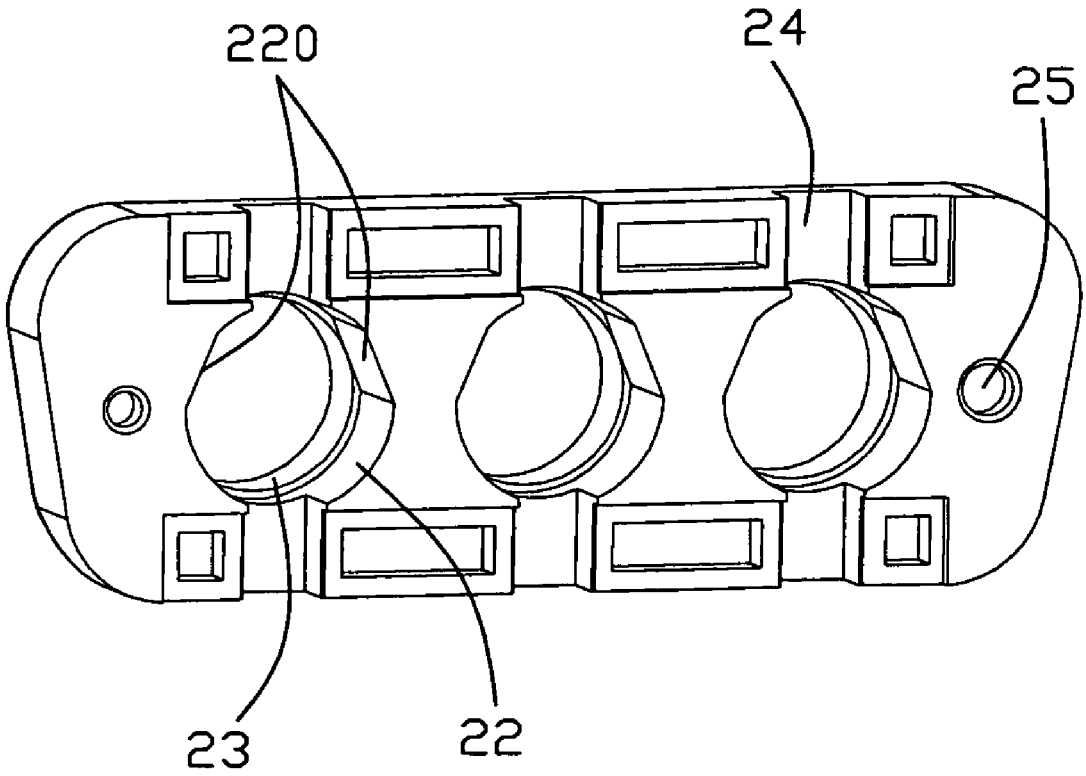
FIG. 5 is a perspective view of a second housing of the electrical connector shown in FIG. 1.

The second housing 2 defines a plurality of cylindrical retaining slots 22 aligned with the receiving slots 110 along the front-to-back direction. The retaining slots 22 communicate with the receiving slots 110 and each defines an inner diameter larger than that of the receiving slot 110. The retaining slots 22 extend through the second housing 2 for retaining the contacts 3 therein. Referring to FIG. 5, each retaining slot 22 defines a pair of first inclined faces 220 at an inner wall thereof and a pair of arc faces connecting the first inclined faces 220 together. The two first inclined faces 220 are symmetrical along the width direction and intersect with each other. The second housing 2 has a projection 23 at a rear side of each retaining slot 22. The second housing 2 further defines a plurality of recesses 24 engaging with the protrusions 102 of the first housing 1, and a pair of holes 25 engaging with the posts 103 of the first housing 1 for fixing the first housing 1 and the second housing 2 together.

The contacts 3 are cylindrical and each has a securing portion 30, a contact portion 33 extending forwardly from the securing portion 30, and a tail portion 34 extending backwardly from the securing portion 30. The securing portion 30 defines an outer diameter larger than that of the contact portion 33 and the inner diameter of the receiving slot 110. The securing portion 32 each has a pair of opposed second inclined faces 300 corresponding to the first inclined faces 220 and abutting against the first inclined faces 220 respectively, a first arc face 301 and a second arc face 302 opposed to the first arc face 301. One ends of the two second inclined faces 300 respectively connect to two opposite ends of the first arc face 301, and another ends of the two second inclined faces 300 respectively connect to two opposite ends of the second arc face 302 to connect the first and second arc faces 301, 302 together. The second arc face 302 is smaller than the first arc face 301. The arc faces of each retaining slot 22 abut against the first and second arc faces 301, 302 respectively.

Each contact portion 33 defines a mating hole 331 extending inwardly from a front end thereof to receive a corresponding plug (not shown). The contact portion 33 defines a plurality of slits 332 for flexibly sandwiching the plug therein. Each tail portion 34 defines a cutout 340 at a rear end thereof for adsorbing soldering tin (not shown) easily. The cutouts 340 of both tail portions 34 open to a same direction.

The front shell 4 is stamped by a piece of metal sheet and comprises a board 40 affixing to the front wall of the base portion 10, and a case portion 41 extending forwardly from the board 40 and surrounding the mating portions 11. The board 40 defines a pair of first fixing holes 410 at two sides thereof and an extending portion 411 extending backwardly from the fixing holes 410.

The rear shell 41 is approximately symmetrical to the front shell 40, and defines a pair of second fixing holes 510 corresponding to the first fixing holes 410.

Figure 6:
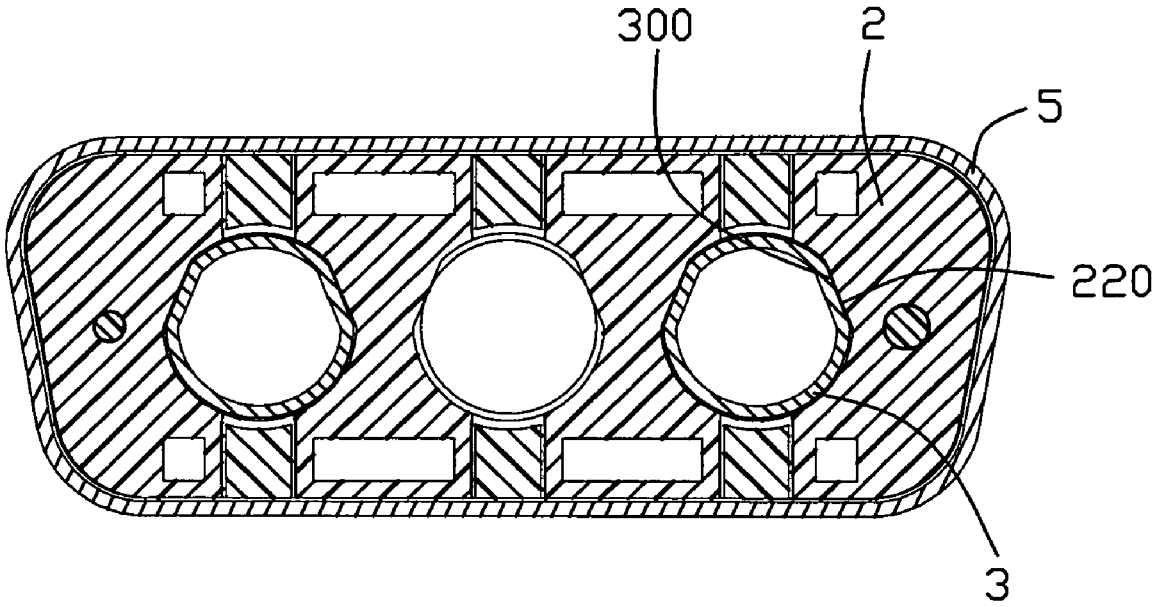
FIG. 6 is a cross-sectional view taken along line 6-6 of FIG. 1.

In assembly, firstly, assembling the contacts 3 to the second housing 2 along the front-to-back direction, the securing portions 30 are retained in the retaining slots 22 from a front end of the second housing 2. A rear end of the securing portions 30 abut against the projections 23 of the retaining slots 22 for preventing the contacts 3 from moving backwardly. Referring to FIG. 6, the second inclined faces 300 of the contacts 3 abut against the first inclined faces 220 for preventing the contacts 3 from rotating. The contact portions 33 extend out of the front end of the second housing 2, and the tail portions 34 extend out of a rear end of the second housing 2.

Secondly, assembling the first housing 1 to the second housing 2, the contact portions 33 extend into the receiving slots 110 from the rear wall of the first housing 1. The rear wall of the first housing 1 abuts against a front end of the securing portions 30 for preventing the contacts 3 from moving forwardly. The protrusions 102 and posts 103 engages with the recesses 24 and the holes 25 respectively for fixing the first and second housing 1, 2 together.

Finally, assembling the front and rear shells 4, 5 to an outside of the insulative housing, the extending portions 411 extend through the second fixing holes 510 for fixing the first and second housings 1, 2 between the front and rear shell 4, 5. The electrical connector 100 of the present invention is assembled completely. The contacts 3 are mounted in the insulative housing stably and can not move along a front-to-back direction and can not rotate in the retaining slot 22.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising: an insulative housing comprising a plurality of receiving slots and a plurality of retaining slots communicating with the receiving slots along a front-to-back direction; and a plurality of contacts retained in the insulative housing, each contact having a securing portion engaging with the retaining slot, a contact portion extending forwardly into the receiving slot from the securing portion, and a tail portion extending out of the insulative housing from the securing portion;

wherein the retaining slot defines a first inclined face at an inner wall thereof, and the securing portion has a second inclined face corresponding to the first inclined face and abutting against the first inclined face, wherein the retaining slot defines a pair of said first inclined faces symmetrically arranged at the inner wall, and the securing portion has a pair of said second inclined faces corresponding to the first inclined faces respectively.

2. The electrical connector according to claim 1, wherein the first inclined faces intersect with each other, and the second inclined faces intersect with each other too.

3. The electrical connector according to claim 2, wherein the securing portion further comprises a first arc face and a second arc face opposed to the first arc face, one ends of the two second inclined faces respectively connect to two opposite ends of the first arc face, and another ends of the two second inclined faces respectively connect to two opposite ends of the second arc face to connect the first and second arc faces together.

4. The electrical connector according to claim 1, wherein the insulative housing has a projection at a rear side of the retaining slot to prevent the securing portion from moving backwardly.

5. The electrical connector according to claim 1, wherein the insulative housing comprises a first housing and a second housing fixed with each other along the front-to-back direction, the receiving slots extend through the first housing, and the retaining slots extend through the second housing.

6. The electrical connector according to claim 5, wherein the receiving slot defines an inner diameter smaller than that of the retaining slot, and the securing portion defines an outer diameter larger than that of the contact portion and the inner diameter of the receiving slot.

7. The electrical connector according to claim 6, wherein the first housing has a rear wall abutting against the securing portions to prevent the securing portions from moving forwardly.

8. The electrical connector according to claim 5, wherein the first housing has a base portion and a pair of mating portion extending forwardly from the base portion, the mating portions are symmetrical along a width direction of the first housing and form a cavity therebetween to receive a corresponding plug, and the receiving slots extend through the base portion and the mating portion.

9. The electrical connector according to claim 1, wherein the contact portions are cylindrical and each defines a mating hole extending inwardly from a front end thereof to receive a corresponding plug.

10. The electrical connector according to claim 9, wherein the contact portion defines a plurality of slits, and the tail portion defines a cutout at an end thereof.

11. The electrical connector according to claim 1, further comprising a front shell and a back shell fixing the insulative housing therebetween.

12. An electrical connector comprising:

an insulative housing comprising a first housing and a second housing fixed with each other along a front-to-back direction, the first housing defining a plurality of receiving slots, the second housing defining a plurality of retaining slots corresponding to the receiving slots; and a plurality of contacts retained in the insulative housing, each contact having a securing portion mounted in the retaining slot from a front end of the second housing, a contact portion extending into the receiving slot from the a rear end of the first housing, and a tail portion extending out of a rear end of the second housing from the securing portion;

wherein the retaining slot defines a first inclined face at an inner wall thereof, and the securing portion has a second inclined face corresponding to the first inclined face and abutting against the first inclined face to prevent the contact from rotating.

13. The electrical connector according to claim 12, wherein the retaining slot defines a pair of said first inclined faces symmetrically arranged at the inner wall and intersecting with each other, and the securing portion has a pair of said second inclined faces corresponding to the first inclined faces respectively, and a pair of opposed arc faces connecting the second inclined faces together.

14. The electrical connector according to claim 12, wherein the second housing has a projection at a rear side of the retaining slot to prevent the securing portion from moving backwardly.

15. The electrical connector according to claim 14, wherein the receiving slot defines an inner diameter smaller than that of the retaining slot, and the securing portion defines an outer diameter larger than that of the contact portion and the inner diameter of the receiving slot.

16. The electrical connector according to claim 15, wherein the first housing has a rear wall abutting against the securing portions to prevent the securing portions from moving forwardly.

17. The electrical connector according to claim 12, wherein the tail portion defines a cutout at a rear end thereof, and the cutouts of all tail portions open to a same direction.

18. An electrical connector comprising: a first insulative housing defining a receiving slot;

a second insulative housing intimately positioned behind the first housing and defining a retaining slot in alignment with the receiving slot;

a metallic contact defining a front expansible contact section received in the receiving slot, and a rigid retaining section received in the retaining slot;

wherein both said receiving slot and said retaining slot are essentially of a columnar shape except that the retaining slot is further equipped with a planar section in some circumferential region to comply with a planar sector on the retaining section, wherein a flange is formed in the retaining slot behind the planar section, and said contact, which is rearwardly inserted into the retaining slot, is equipped with another flange behind the planar sector to be seated upon said flange.

* * * * *